US007810667B2

(12) United States Patent
Douglas et al.

(10) Patent No.: US 7,810,667 B2
(45) Date of Patent: Oct. 12, 2010

(54) SUPPLY OF PACKAGING BAGS FOR A FILLING APPARATUS

(75) Inventors: Steven Douglas, West Sussex (GB); Gavin Barnett, Gloucestershire (GB)

(73) Assignee: The Green Drinks Company, Ltd., Herstmonceux, East Sussex (GB)

( * ) Notice: Subject to any disclaimer, the term of this patent is extended or adjusted under 35 U.S.C. 154(b) by 0 days.

(21) Appl. No.: 11/885,845

(22) PCT Filed: Mar. 8, 2006

(86) PCT No.: PCT/GB2006/000829

§ 371 (c)(1),
(2), (4) Date: Jun. 5, 2008

(87) PCT Pub. No.: WO2006/095172

PCT Pub. Date: Sep. 14, 2006

(65) Prior Publication Data

US 2009/0071859 A1 Mar. 19, 2009

(30) Foreign Application Priority Data

Mar. 9, 2005 (GB) ..... 0504861.6
Nov. 1, 2005 (GB) ..... 0522306.0

(51) Int. Cl.
*A47G 19/00* (2006.01)

(52) U.S. Cl. ..... 220/23.4; 220/23.2; 220/23.83; 206/390; 206/820; 383/37; 53/469; 53/274; 53/284.7

(58) Field of Classification Search ..... 206/390, 206/343, 526, 820; 220/23.2, 23.4, 23.83, 220/691, 840; 53/467, 469, 266.1, 268, 274, 53/284.7; 383/37

See application file for complete search history.

(56) References Cited

U.S. PATENT DOCUMENTS 2,342,477 A * 2/1944 Magnenat ..... 220/835
3,083,429 A * 4/1963 Barlow et al. ..... 24/693
3,295,710 A * 1/1967 Marchant ..... 220/23.8
3,358,821 A 12/1967 Weisberg
3,366,265 A * 1/1968 Hesselbarth ..... 220/23.4
3,815,281 A * 6/1974 Kander ..... 446/77
D236,585 S * 9/1975 Tabor et al. ..... D9/740
3,985,229 A * 10/1976 Maki ..... 206/315.6

(Continued)

FOREIGN PATENT DOCUMENTS

EP 1 216 929 6/2002

(Continued)

OTHER PUBLICATIONS

The International Search Report for PCT/GB2006/000829; Filed Mar. 8, 2006; Date of Completion May 3, 2006; Date of Mailing May 16, 2006.

*Primary Examiner*—David T Fidei
(74) *Attorney, Agent, or Firm*—Alston & Bird LLP

(57) ABSTRACT

A ribbon of packaging comprises individual packages (11) adjacently and separably arranged for separation prior to filling. The ribbon is preferably drawn under tension from a reel, and the packages are linked by mechanical couplers (FIG. 11) which are separable in a direction orthogonally to the traction force. The packages have a closure (FIG. 8) which is removed and replaced to permit filling. Also disclosed are preferred package couplers, and filling and dispensing arrangements.

10 Claims, 14 Drawing Sheets

U.S. PATENT DOCUMENTS 4,133,445 A * 1/1979 Mandelbaum ..... 220/23.4
4,676,285 A 6/1987 Schieser et al.
4,886,239 A * 12/1989 Stimmel ..... 249/117
5,702,017 A * 12/1997 Goncalves ..... 220/23.4
6,073,422 A * 6/2000 Massey et al. ..... 53/471
6,644,487 B2 * 11/2003 Smith et al. ..... 215/235
6,668,517 B2 * 12/2003 Hiramoto et al. ..... 53/133.2
2007/0051073 A1 * 3/2007 Kelley et al. ..... 53/440

FOREIGN PATENT DOCUMENTS

| | | |
|---|---|---|
| EP | 1 405 622 | 4/2004 |
| JP | 2000 033957 | 2/2000 |
| JP | 2001 112847 | 4/2001 |
| WO | WO 99/42368 | 8/1999 |
| WO | WO 02/055402 | 7/2002 |

* cited by examiner

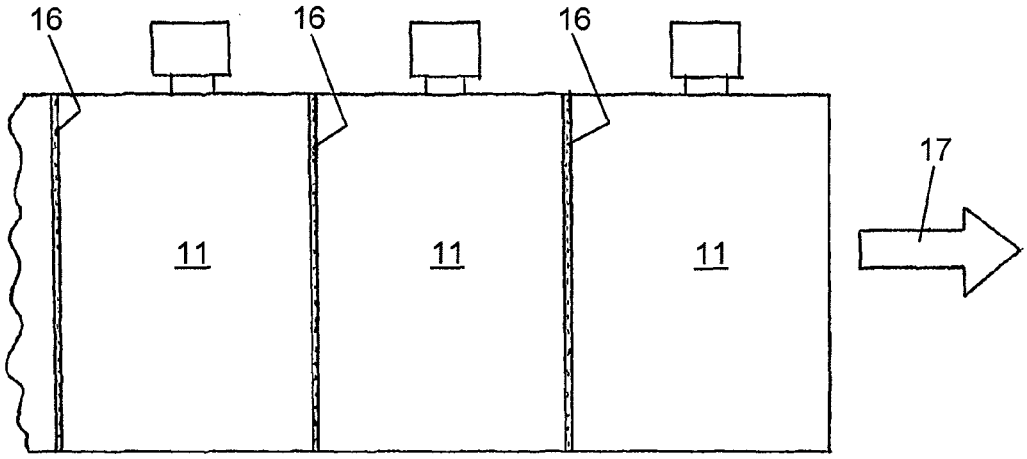
Fig. 4
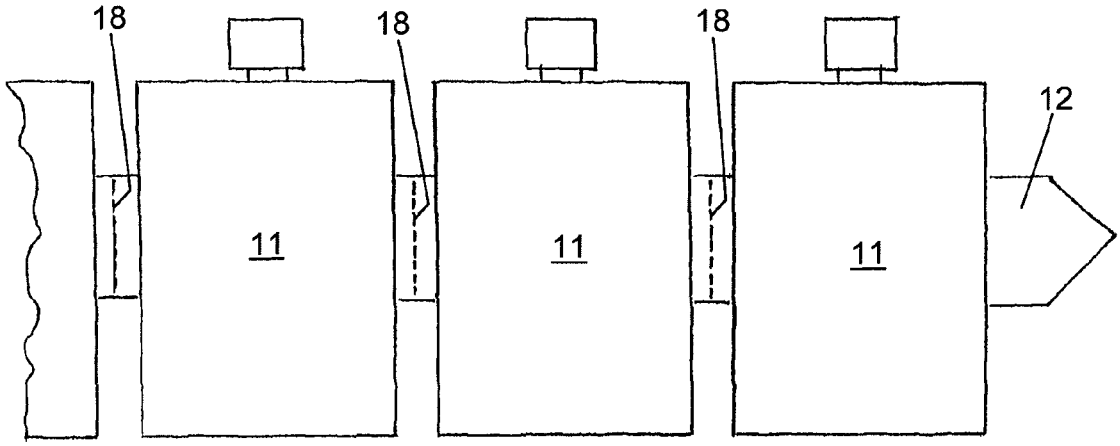
Fig. 5
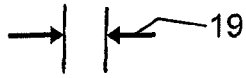

SUPPLY OF PACKAGING BAGS FOR A FILLING APPARATUS

BACKGROUND OF THE INVENTION

This invention relates to packaging for material from a bulk source and to a dispenser of successive packages, particularly packages intended for liquid, for example drinks. Other related aspects of such packages, and the transport and filling thereof are also disclosed.

Drinks are often supplied in sealed containers, such as bottles. Considerable cost is incurred in transporting such containers to a filling plant, and then distributing the containers to a retail outlet. Potable mains water is widely available, but is not available on demand to a consumer in an easily transportable and hygienic form.

It would be desirable to provide potable mains water on demand from a vending machine, and in hermetically sealed packaging. Such a machine can avoid transport of filled containers, and can thus provide drinks at a low cost. Difficulties however arise in providing suitable packaging, and in ensuring that a sufficient quantity of packaging is available to meet a reasonable service interval, whilst ensuring that the vending machine is neither complex nor likely to be unreliable.

It would also be desirable to provide a means of packaging flowable bulk material, whilst avoiding the expense of large scale purpose built machinery. A solution to this problem would be especially useful to low volume producers who may wish to package locally. Fully formed flexible packaging, for example in bag form, is useful, but is somewhat difficult to handle because the desirable feature of flexibility is a disadvantage in machinery. Rigid containers such as boxes and bottles are relatively easy to handle and transport, but are space hungry when empty.

SUMMARY OF THE INVENTION

According to a first aspect of the invention there is provided a supply of packaging for material from a bulk source, the packaging comprising individual packages adjacently and separably arranged, each package having a filling location at a free side, and the packaging comprising a ribbon adapted to be supplied from a store.

Preferably the packaging is adapted to transmit ribbon movement forces, and in a preferred embodiment is drawn under tension from a store.

Preferably the packaging consists of individual packages each comprising a portion adapted to be filled with material from a bulk source which in use is not subject to ribbon movement forces, and another portion adapted to transmit ribbon movement forces in use.

The packages may be arranged side by side, and may overlap to increase packing density, if desired. For example closures of adjacent packages may be adjacent, whereas fluid containers of adjacent packages may overlie.

Such an arrangement allows a reel of packaging to be supplied to a filling station for the individual packages, the ribbon being inherently adapted to resist separation whilst under ribbon movement forces from supply apparatus. Individual packages may be separated on demand, for example by guillotine, or by perforations adapted to resist ribbon movement forces but to be separable on application of a force along the axis thereof.

As a preferred alternative the individual packages may have mechanical connectors, such as peg and slot or hook type connectors, to permit coupling and uncoupling of adjacent packages on demand. Such connectors are in a preferred embodiment of the snap-fit type, the separation force being less than that required for ribbon movement. In one embodiment, the separation direction is orthogonal to the ribbon movement direction so that accidental separation under movement forces is obviated.

Preferably the individual packages comprise a flexible container, for example of sheet plastic material such as polythene or the like, and a relatively rigid closure assembly which in use defines a filling and/or discharge aperture. Ribbon movement forces are preferably directed via adjacent closure assemblies.

Supply under traction is preferred since a ribbon under tension is somewhat easier to control. Supply by pushing is also envisaged, especially pushing via packages at the dispensing end of the ribbon.

Packages may be typically rectangular, having two opposed sides adjacent to sides of neighbouring packages, and a third side defining a filling and/or dispensing aperture.

Preferably each individual package in the ribbon is identical. In a preferred embodiment each package is provided with a cap which is removable for filling, and replaceable after filling.

In the preferred embodiment the packages are suitable for liquid (especially potable mains water) are adapted for hermetic sealing prior to filling and are adapted for hermetic sealing after being filled. Suitable hermetic sealing is by way of a screw cap.

In one embodiment of the invention said ribbon comprises a tape, and sequential individual packages attached to said tape, the packages being arranged side by side.

Such a supply can for example be wound on a reel, and drawn from the reel by the tape for sequential presentation to a filling station. In this arrangement, the tapes resist tractive effort, thus leaving the individual packages unstressed. For stability the packages may be sequentially provided on twin parallel tapes.

In one embodiment rectangular packages are sequentially provided with filling and/or drinking openings on side edges which are not crossed by the tape(s). In one embodiment adjacent packages are arranged nose to tail, with the filling/emptying openings facing in opposite directions. Such an arrangement maximizes the number of packages which can be stored together, e.g. on a reel or spool, because the filling/emptying openings are less likely to coincide, half being on one side and half on the other. Adjacent packages may partially overlap on the tape(s).

The tape traction embodiments permit adjacent packages to be variably spaced on the tape(s). Whilst immediate adjacency ensures maximum capacity of a linear array, it may be desirable to provide a gap to prevent coincidence of filling/emptying openings, and consequent bunching.

As an alternative to separation, transport tape(s) may include perforations to allow a tape residue to be separated with each package, or a guillotine may be provided to shear the tape as each package is separated; these methods avoid the need to deal with an accumulation of used tape within the filling apparatus.

In a preferred embodiment twin tapes are provided, each tape having packages provided sequentially thereon.

The packages may be generally immediately adjacent, so that the tapes and respective packages overlie. Alternatively the packages may be spaced to allow side by side tapes with packages nested one between the other. One advantage of a twin tape provision, for example on a reel, is that packages on one tape can be arranged with openings to one side, whilst packages on the other tape can be arranged with openings to the other side, and the tapes can be turned oppositely through 90° as they are drawn out, to present successive packages in the same orientation to, for example, a station for filling.

Tape(s) of the kind mentioned can present successive packages to a transport device, such as a mechanical grab, and in the preferred embodiment are subsequently released from the packages for storage and disposal. The packages may for example be attached to tape(s) by a releasable adhesive, and separated on application of a suitable shear force.

Where reels are used, a removable internal spindle may be supplied with each reel so as to provide a means for winding-on used tape(s). Such a spindle can be accommodated elsewhere in the vending machine, and may be driven so as to draw tape(s) and packages from the respective reels, for example by electric stepper motor. In such a case the loaded tapes may be provided with a start length upstream of the first package.

As an alternative used or loaded tape may be stored in a concertina fashion.

In a vending machine, each package may be identified by registration means so as to be independent of the tape length drawn off. Thus the vending machine does not need to be programmed with the position of each package on the tape(s), and can accommodate tapes with packages at variable spacing.

The ribbon provides a means by which flexible packaging can be handled and transported in a reliable manner. A large quantity of such packaging can be flat packed in roll or concertina form, and is thus suitable for a vending application, and is adaptable to low volume filling operations using relatively unsophisticated machinery.

In a preferred embodiment the packages are fully formed and flat prior to filling, and include a folded gusset to permit expansion thereof during filling. The packages may for example be generally rectangular, and have a filling opening provided on one edge. In a preferred embodiment the packages consist of flexible plastic sheet material, having a filling and or discharge opening comprising a spout or mouth, for example of moulded plastics.

A particular advantage of ribbon transport is that when drawn from the supply, a ribbon may be twisted so as to present the packages attached thereto in a pre-determined orientation. Thus for example flat packages drawn from a horizontal axis reel may be turned through 90° to be presented generally vertically to e.g. a station at which the packages are separated for filling.

In one preferred embodiment, flat flexible packages have a relatively thick spout which defines a filling and/or emptying aperture. Spouts of adjacent packages can be nested on a hub, as already explained. The thick spout is typically moulded of plastics and may define on the exterior a peripheral channel engageable between rails of a transport device. Where adjacent spouts are connected, a hub may be unnecessary, and the spouts/packages simply coiled in a spiral.

Preferably the packages have caps attached thereto to maintain hygiene. A separate filling opening may be provided, but in the preferred embodiment caps are mechanically removed and replaced during the package filling operation.

In one embodiment about 250 packages of 200-500 ml can be accommodated as a reasonable size of reel. Several reels can be provided in a suitable packaging machine. Typically water is provided as the main or only ingredient. Additives and flavourings may be added. Each reel may have packaging tailored to a specific kind of drink, and may identify itself to the vending machine by an identification device such as an embedded chip or RFID tag.

The vending machine may include opening, filling and closing stations, in addition to cooling and filtering and flavouring. Furthermore the vending machine may be arranged to dispense on demand at no cost, so called free-vend, so as to be usable in for example an office environment.

According to a second aspect of the invention there is provided a package comprising a flexible container for fluid material and a relatively rigid closure, the closure comprising a neck and a cap for the neck, and said closure further including oppositely directed male and female coupling members thereon whereby several such packages may be linked to form a ribbon.

In a preferred embodiment the package is internally sterile, and sterility is maintained by the applied closure. Thus the closure provides a hermetic seal. Preferably the closure and container are manufactured/assembled under sterile conditions and/or are sterilized after manufacture/assembly by suitable radiation or atmospheric treatment.

Preferably the male and female couplings are adapted to resist a ribbon movement force in a first direction, and to be separable on application of a disengagement force in a second direction substantially orthogonal to said first direction.

The male coupling and female coupling are preferably adapted for snap-fit engagement.

In a preferred embodiment the male coupling comprises a pin extending in a direction substantially parallel to said neck, and the female coupling comprises a "C" shaped mouth, preferably a hook.

In a preferred embodiment said hooks face outwardly when said ribbon is coiled. In the event of curvature in the opposite direction, in which hooks face inwardly, adjacent spouts are adapted for contact so as to prevent an included angle of less than 90°; in this way inadvertent release of hooks and pins is obviated.

Preferably the flexible container is of plastics material such as polythene, and the closure is of a relatively rigid moulded plastic of any suitable kind. The cap is preferably a screw cap, and may incorporate tamper evidence and/or child resistant features of any suitable kind. Thus the rigid closure may exert ribbon movement forces on its neighbour(s) whilst avoiding any strain on the flexible container.

According to a third aspect of the invention there is provided a vending machine comprising a generally upright cabinet being adapted at opposite sides for respective reels of ribbon packaging, the proximal ends of said reels presenting in use to a filling mechanism for individual packages of said packaging, the filling mechanism being arranged between said reels, and adapted for gravity dispensing of filling packages.

Preferably two reels are provided at each side, and thus four proximal reel ends are presented at the filling mechanism, two reels unwinding upwardly, and two reels unwinding downwardly. This arrangement provides for convenient storage of a large volume of packaging whilst presenting the proximal ends at substantially the same location for a single filling mechanism. Reels are typically used successively until exhausted, and the filling mechanism includes means to index to the next successive reel upon exhaustion of the former.

When adapted for dispensing of potable water, suitable flavouring concentrates may be arranged above the filling mechanism and between said reels. The region below the filling mechanism and between the reels may comprise a dispense chute and typical conditioning apparatus such as a chiller, filter and the like.

According to a fourth aspect of the invention, there is provided a handling mechanism for empty capped containers arranged side by side in a ribbon, the mechanism comprising a frame, a gripping head pivotable on the frame about a first axis, and having a cap gripper reversibly movable on a second axis orthogonal to said first axis, said mechanism further including a jaw pivotable about a third axis orthogonal to said first axis, said jaw being adapted for registration with said gripper so as to permit transfer of an empty capped container from said ribbon via said gripping head to said jaw for arcuate movement to a filling station.

Preferably said cap gripper is rotatable relative to said gripping head, and said jaw include means to hold a container against rotation relative thereto. By these means a cap may be unscrewed by relative rotation of said cap gripper, and withdrawn axially along said second axis so as to permit an uncapped mouth to be presented to the filling station by pivoting of said jaw. After filling the cap may be replaced by reverse motion of the jaw and cap gripper, and released. In a preferred embodiment said jaw is pivotable in one direction towards a filling station, and in the opposite direction towards a delivery chute.

Preferably the ribbon comprises a plurality of containers linked by peg and slot connection, adjacent containers being released by relative arcuate motion. Thus relative rotation of the cap gripper in the screwing-on direction of the cap may be utilized to disengage a proximal container from its neighbour, as will be further described herein.

In a preferred embodiment said handling mechanism may further including indexing means whereby said gripping head is adapted to advance the proximal container from a backward to a forward position for further handling. In this way the neighbouring container is advanced to the backward position for the next successive cycle of operation, and separate indexing means are not required for the or each ribbon.

Such indexing means may for example comprise a reciprocal carriage for the gripping head. Preferably said gripping head is also adapted for indexing between presenting locations for the proximal ends of container reels. For example the griping head may be mounted on a horizontal axis turntable, indexable through 90° stop positions to engage one of four said proximal reel ends on demand.

BRIEF DESCRIPTION OF THE DRAWINGS

Other features of the invention will be apparent from the following description of preferred embodiments shown by way of example in the accompanying drawings in which:

FIG. 4 is a schematic illustration of a fourth embodiment of the invention.

FIG. 5 is a schematic illustration of a fifth embodiment of the invention.

DETAILED DESCRIPTION OF THE DRAWINGS

Figure 1:
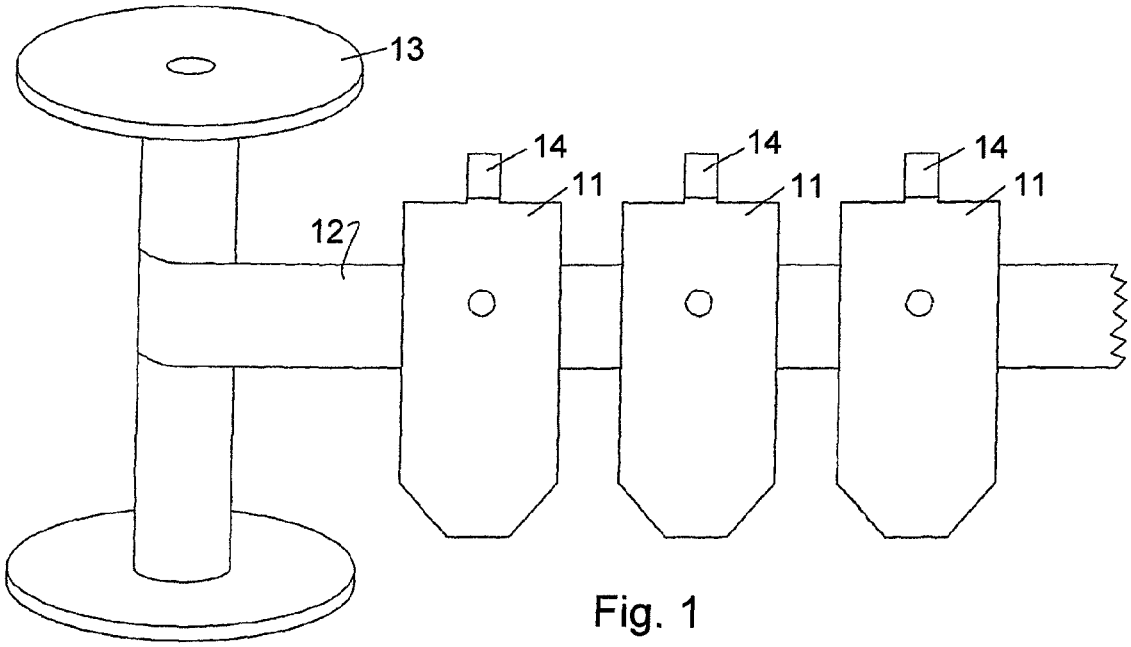
FIG. 1 is a schematic illustration of one embodiment of the invention.
Figure 2:
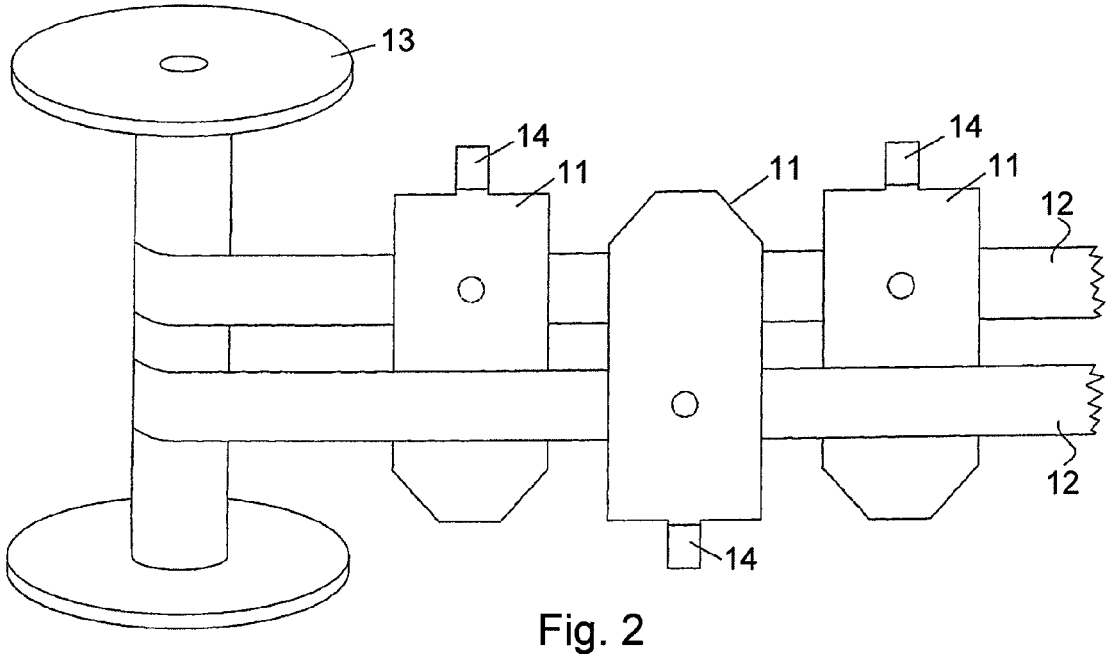
FIG. 2 is a schematic illustration of another embodiment of the invention.

FIGS. 1 and 2 illustrate how a ribbon of flat packages 11 can be mounted on tape(s) 12 and wound on a reel 13. The packages 11 have filling necks 14 which may be relatively thick, and FIG. 2 shows how the packages can be oppositely directed to avoid bunching on the reel. In the embodiment of FIG. 2, the oppositely directed packages are mounted on separate tapes, and are drawn off the reel successively, as illustrated. The tapes may be turned oppositely through 90° downstream of the reel to align the packages in the same orientation, for example with neck uppermost.

Figure 3:
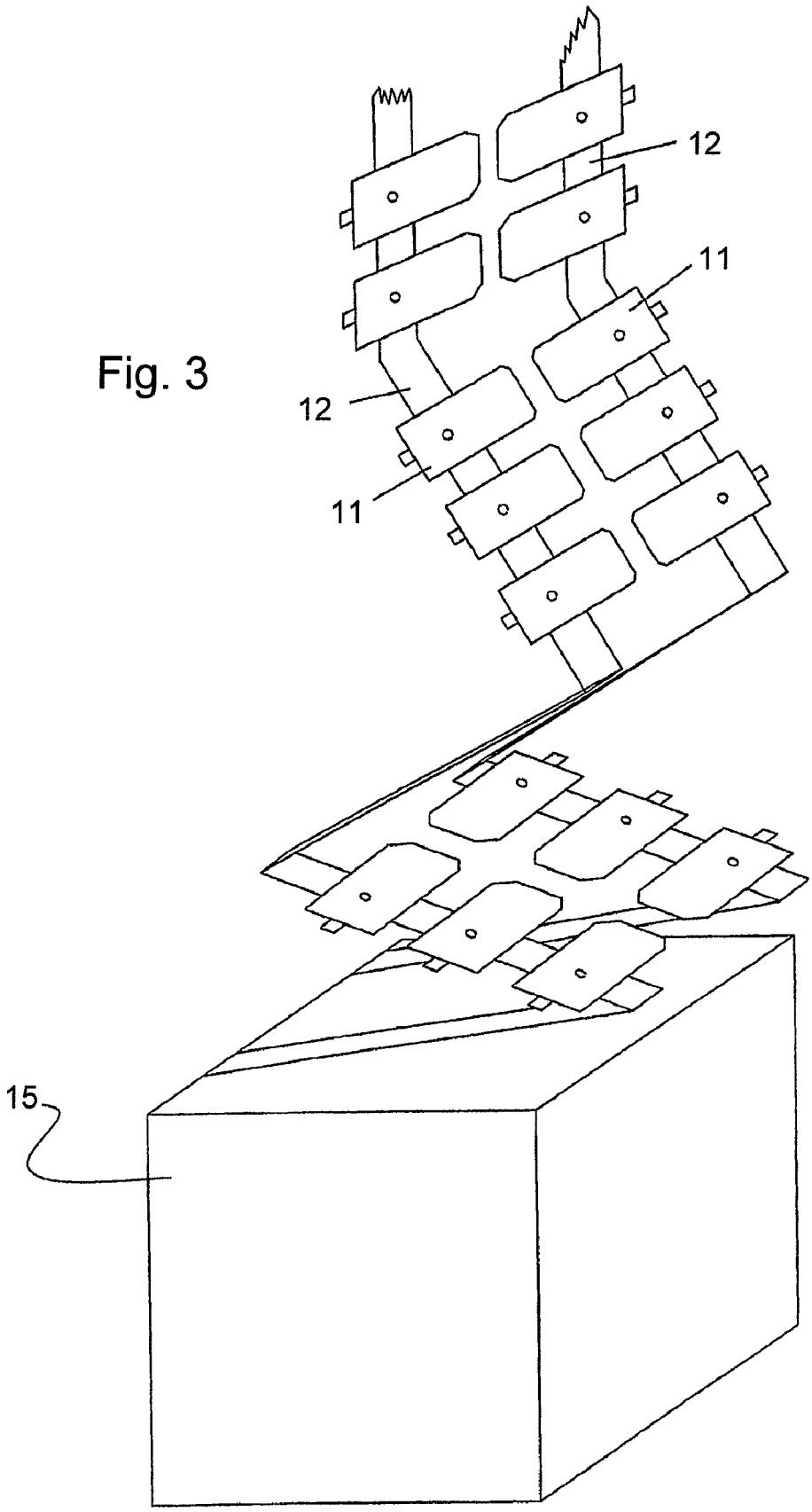
FIG. 3 is a schematic illustration of a third embodiment of the invention.

FIG. 3 illustrates how packages 11 may be stored on tape(s) 12 in concertina fashion, and drawn from a box 15.

FIG. 4 illustrates in plan a ribbon of flat packages 11 having perforations 16 to permit separation thereof, the perforations resisting traction forces in the direction of arrow 17, but being adapted to permit separation of the individual packages on demand, for example by application of a lateral shearing force. A knife may be provided for cutting a non-perforated portion between edge seams of adjacent packages.

FIG. 5 shows a tape transport similar to FIG. 1 but in which individual tape sections are separated as each package is separated, so as to leave the tape section with the separated package. For this purpose tape perforations 18 may be provided, or the tape may be guillotined. The gap 19 between adjacent packages is increased for illustration purposes; in practice it is envisaged that the gap will be very small, and of the order of 1-2 mm or less.

Figure 6:
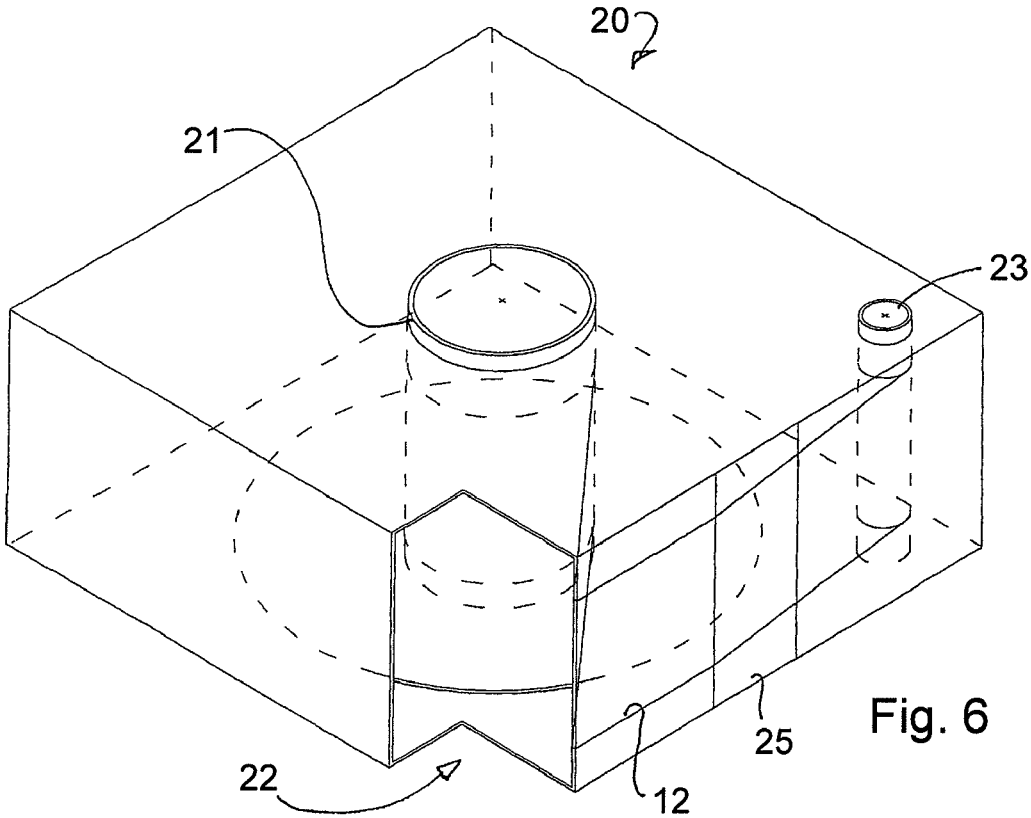
FIG. 6 is a schematic isometric view of a reel cartridge.
Figure 7:
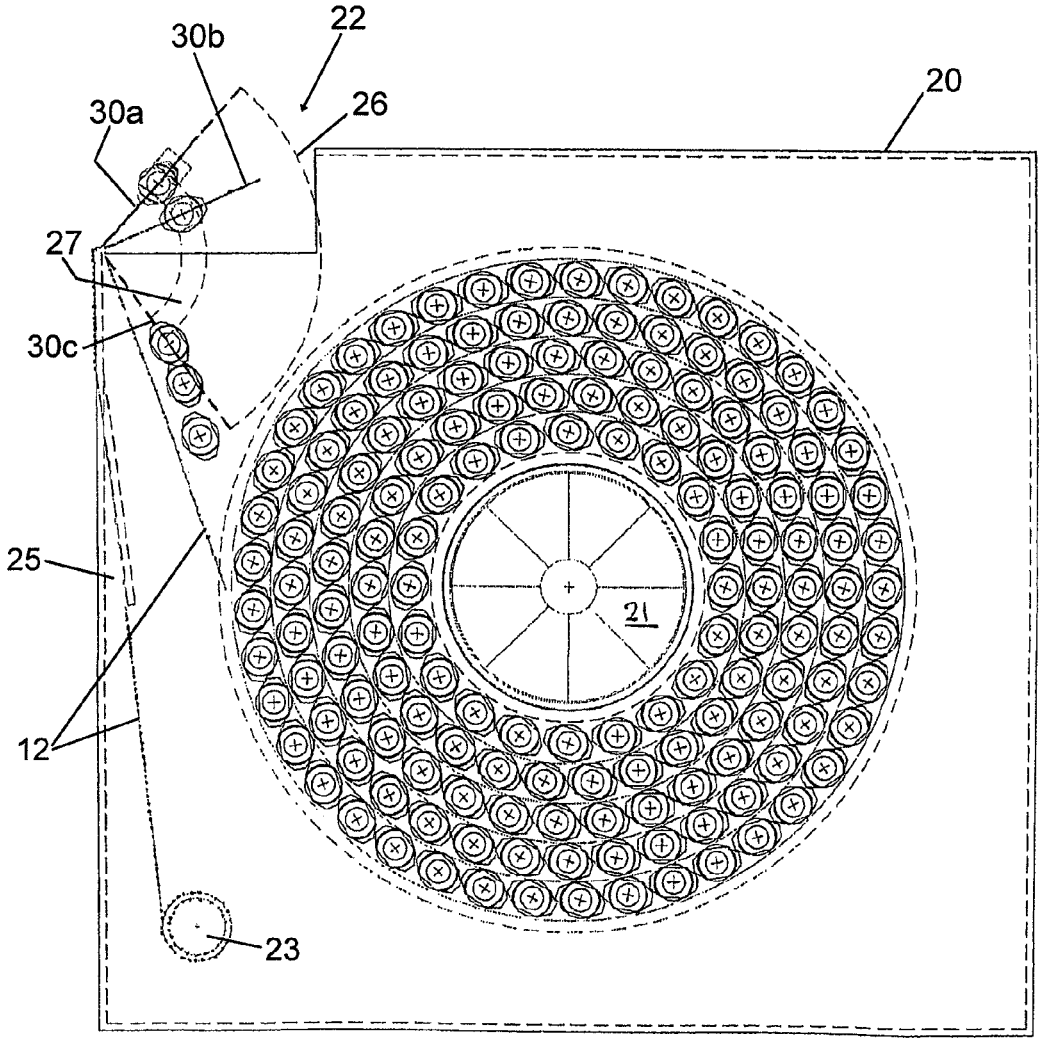
FIG. 7 is a schematic plan view of the cartridge of FIG. 6 with top removed.

FIGS. 5, 6 & 7 illustrates schematically a cartridge dispenser for a ribbon of packages according to the invention. The dispenser is in the form of a replaceable cassette.

The dispenser comprises a generally rectangular box 20 having a rotatable spool or reel 21 in the centre thereof. A rectangular cut-out 22 is provided at one corner, and constitutes an exit aperture for individual packages. A second smaller diameter spool 23 is provided at a corner and within the box adjacent the cut-out 22; this second spool constitutes a take-up for a transport tape 12, and is driven from the exterior of the box by a suitable drive mechanism.

Figure 8:
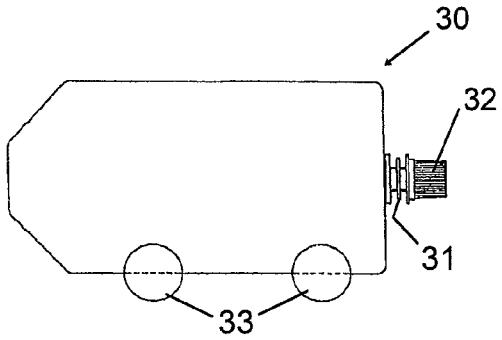
FIG. 8 is a plan view of a package for use in the dispenser of FIG. 6.

A suitable package for use with the tape 12 is illustrated in FIG. 8, and comprises a collapsed (flat) flexible container 30 of eg. plastic material, with an integral spout 31 and cap 32. Such packages 30 are arranged on the tape 12 in successive overlapping relationship with neighbours, and are retained by adhesive pads 33 along one side edge. The spouts of neighbouring packages are immediately adjacent.

In use the larger spool 21 is wound with overlapping packages, which are presented at the cut-out 22. The tape 12 turns around the corner of the cut-out 22 and tends to flip out packages one by one along an arc represented by dotted line 26. Successive packages are marked 30*a*, 30*b*, 30*c*. The arc of travel of the spout/cap is indicated by pathway 27.

The action of flipping out successive packages has a two-fold advantage; firstly each package is separated from its neighbour on the tape 12, and secondly each package is presented for take-up by a suitable transport mechanism for subsequent filling and dispensing. The packages may be separated from the tape by pulling, or suitable perforations may be provided to allow the adhesive pads 33 to part. A mechanical grab or vacuum transfer device may be appropriate. The bare tape then passes along the outside of the box and through an opening 25 in the side wall to the take-up spool 23, so that rotation thereof will index packages to the outside of the box as required.

Preferably the box 20 is made of recyclable material such as cardboard, as may the spools 21,23 and tape 12. The cassette is thus readily disposable after first use, or at the end of its life if re-used.

Figure 9:
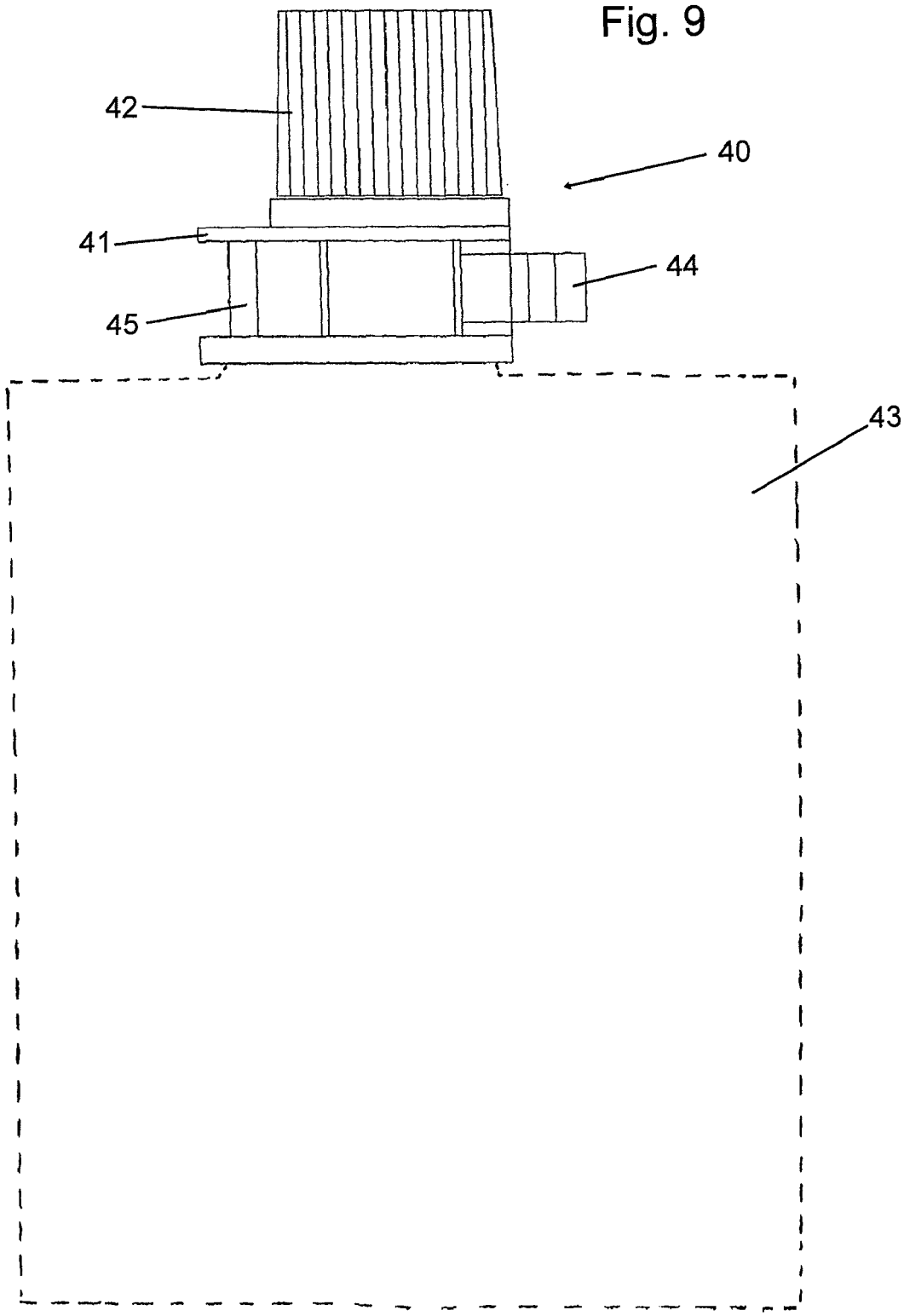
FIG. 9 is an elevation of a package in accordance with the invention.
Figure 10:
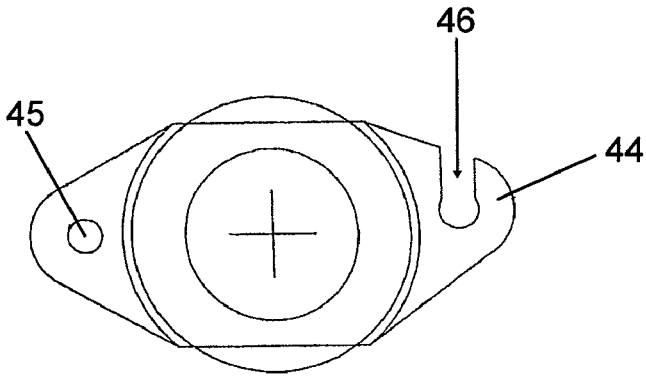
FIG. 10 is a plan view of the neck illustrated in FIG. 9.

A further embodiment of the invention is illustrated in FIGS. 9 and 10. A package 40 comprises a moulded plastics spout or neck 41 having a cap 42 thereon, and is attached by any suitable method to an enclosure 43 for fluid material represented schematically in dotted outline.

Each spout 41 includes left and right side lateral extensions respectively comprising a hook 44 and a pin 45 adapted to be received in a hook 44. The precise nature and form of the hook and pin may be changed to suit circumstances of use, provided that they are disengageable on demand by a suitable release mechanism. As illustrated, each hook 44 has a mouth 46 directed substantially orthogonally to the axis of the lateral extensions, and is narrowed at the opening to provide a snap fit of the pin 45. The pin 45 is circular in section, and is thus permitted to move arcuately in the hook 44.

In manufacture, a plurality of moulded spouts 41 with caps 42 will be sterilized by irradiation, or by submerging in a suitable gas atmosphere, and delivered in sterile form for moulding or welding of the flexible enclosure 43. Suitably sterile conditions are maintained so as to ensure that the empty closed container is in sterile form when assembled into a ribbon. The sterile container is then uncapped filled and re-capped. This arrangement is in contrast to prior sterilization routines which generally provide sterilized but uncapped containers to a filling station.

Figure 11:
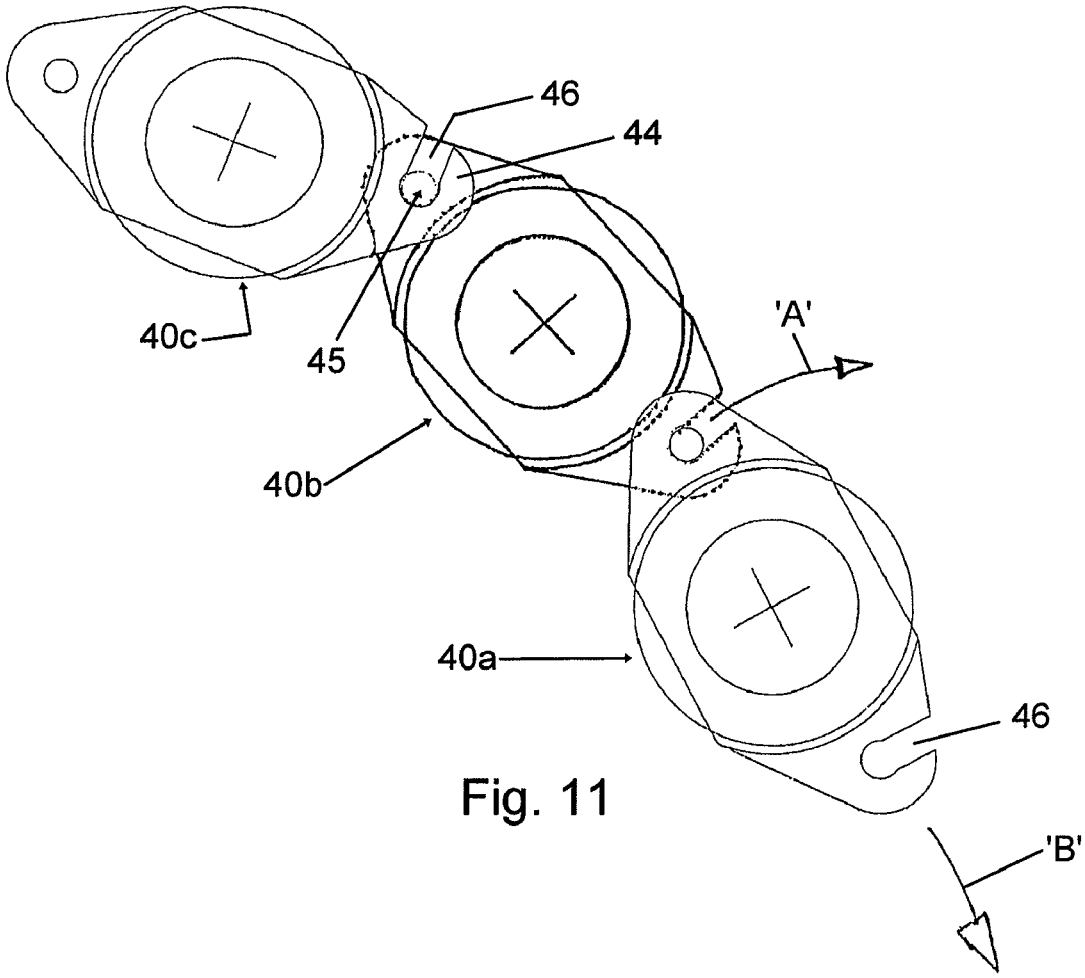
FIG. 11 is a plan view of a chain of neck of FIG. 10.

FIG. 11 shows a chain of connected packages 40*a*, 40*b*, 40*c* and illustrates that the pin and hook connection allows the chain to follow an arcuate path 'B', for example from a reel of unused packages through uncapping, filling and re-capping stations of a drinks dispenser. The enclosures 43 may lie flat and overlap, as illustrated by way of example in FIG. 12.

The leading package can be disengaged at the appropriate time by relative movement in the direction of arrow 'A' (i.e., in a direction orthogonal to the ribbon movement direction 'B')—thus permitting independent processing of package 40*a*, which may be downstream or upstream of a filling station.

In use a ribbon of spouts 40 may be wrapped on a reel of the kind illustrated in FIG. 7 and drawn out in sequence. A leader tape of any suitable kind may be attached to the hook of the first package.

Although FIG. 11 illustrates package 40*a* with hook 44 foremost, it will be appreciated that the pin 45 could be arranged at the leading side.

Figure 12:
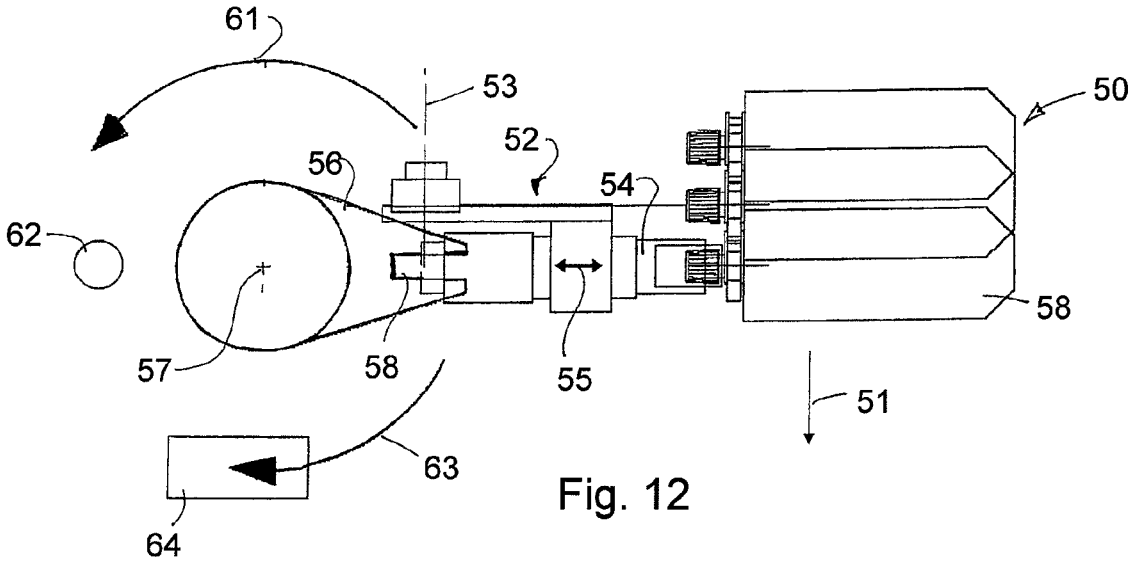
FIG. 12 is a schematic plan view of container handling apparatus.

Schematically illustrated in FIG. 12 is an apparatus for handling and filling a flexible container of the kind illustrated in FIGS. 9-11.

A ribbon of connected packages 50 (three shown) is arranged for advancement in the direction of arrow 51. A gripping head 52 is pivotable about a first axis 53, and carries a cap gripper 54 which is reciprocal with respect to the head 52 on an axis represented by arrow 55.

A pivotable jaw 56 is mounted for arcuate movement about a third axis 57 (orthogonal to the plane of FIG. 12); the mouth 58 of the jaw being arranged in register with the cap gripper 54 when pivoted through 90°, such that the proximal container 58 can be transferred thereto. As depicted, the jaw 56 is below the gripping head 52 as will become apparent.

The jaw is reciprocally pivotable in a first direction 61 to a filling station 62, and in a second direction 63 to a dispensing chute 64.

In use the ribbon of packages 50 is advanced one by one for separation and filling. Such advancement is preferably by reciprocal movement of the gripping head in the direction of arrow 51, and for this purpose the head may be mounted on a reciprocating carriage (not shown) which is in turn mounted on a relatively fixed frame which also defines axis 57.

Figure 13:
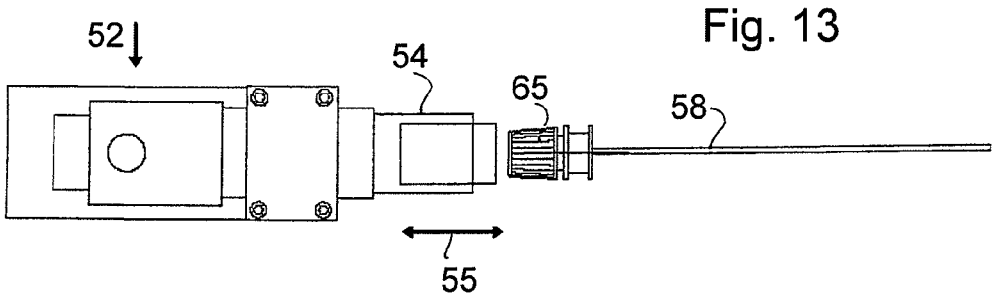
FIG. 13 is a side elevation of a gripping head of FIG. 12 with gripper in a first position.

FIG. 13 illustrates the initial positional relationship of gripping head 52 and the proximal container 58. Suitable guide means (not illustrated) are provided to locate the cap 65 in register with the cap gripper 54.

Figure 14:
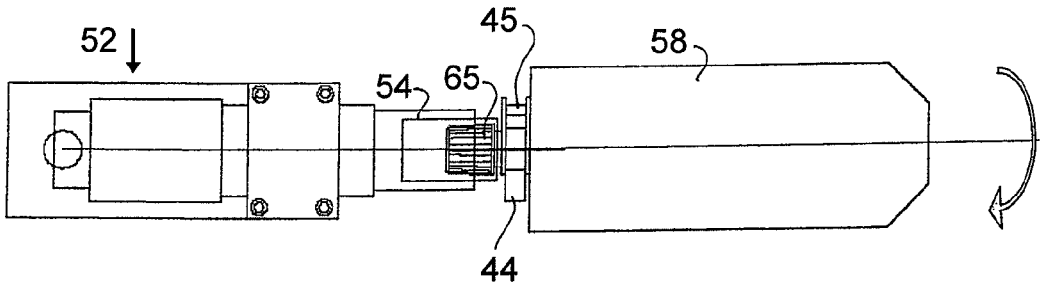
FIG. 14 is a side elevation of a gripping head of FIG. 12 with gripper in a second position.

FIG. 14 illustrates advancement of the gripper 54 to engage and grip the cap 65. The gripper may be a snap or friction fit, or may include jaws or a collet which close upon the cap 65. In the preferred embodiment the head 52 is then indexed one step in the direction of arrow 51.

Having gripped the cap 65, the gripper 54 is then pivoted through 90°, in the screwing-on direction of the cap (as illustrated in FIG. 14), to release the pin and hook connection with the next distal neighbouring container. The proximal container is thus released from the ribbon.

Figure 15:
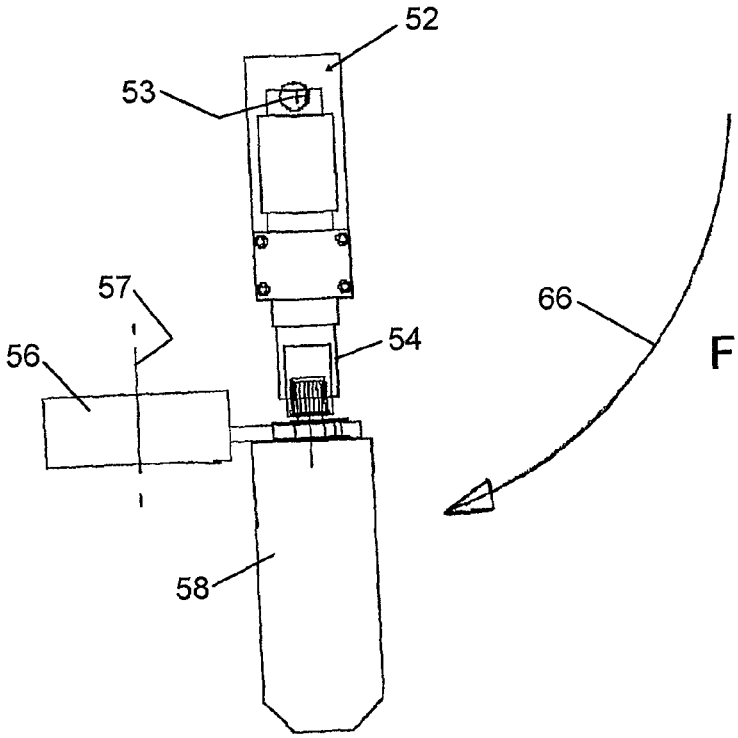
FIG. 15 is a side elevation corresponding to FIG. 14 with the gripping head in a second position.
Figure 16:
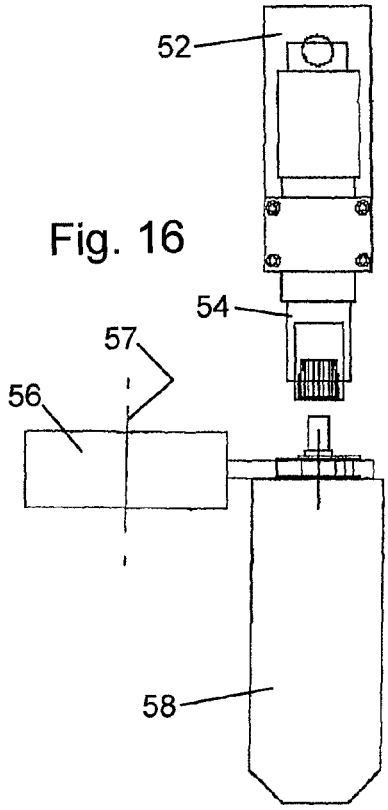
FIG. 16 corresponds to FIG. 15 and shows cap removal.
Figure 17:
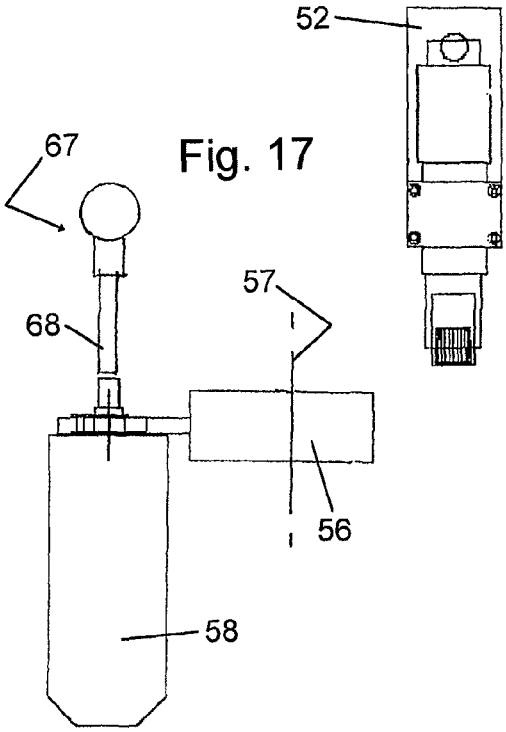
FIG. 17 corresponds to FIG. 16 and shows a filling station.

The next sequence of operation is illustrated in FIGS. 15-17. In FIG. 15, the head 52 is pivoted down (as illustrated) in the direction of arrow 66, about axis 53 to engage the neck of the container in the mouth 58 of the jaw 56. The cap is unscrewed by rotating the gripper 54 in the unscrewing direction, and the gripper 54 is retracted (FIG. 16) to leave the container 58 uncapped. The jaw 56 is then pivoted through 180° to deposit the container below a filling station 67 of any suitable kind (FIG. 17), and which may for example comprise a filling spout 68 engageable with the container, and valve means (not shown) to meter a quantity of fluid into the container.

After capping the jaw reverses to the position of FIG. 16 and the cap is replaced by corresponding movement of the gripper 54. The container 58 is now ready for delivery. The gripper 54 disengages the cap by retraction, and returns to the condition shown in FIG. 13 where it is ready to engage the cap of the next empty container. The jaw pivots to the chute 64 (FIG. 12) so as to permit the full container to be delivered to the user. Subsequently the jaw returns to the position of FIG. 12 and is ready to receive the next container for uncapping, filling and re-capping.

It will be appreciated that means is required to prevent rotation of the container during uncapping and re-capping. For this purpose the container neck has a non-circular form so as to be engageable in the mouth 58 in a manner to resist relative rotation—the pin and hook 44,45 may provide such non-circular form, or another neck portion may be provided having for example a square section.

Movement of the gripping head 52, gripper 54 and jaw 56 may be by any suitable means, for example electric servo motor or pneumatic actuator, or a combination of both.

Figure 18:
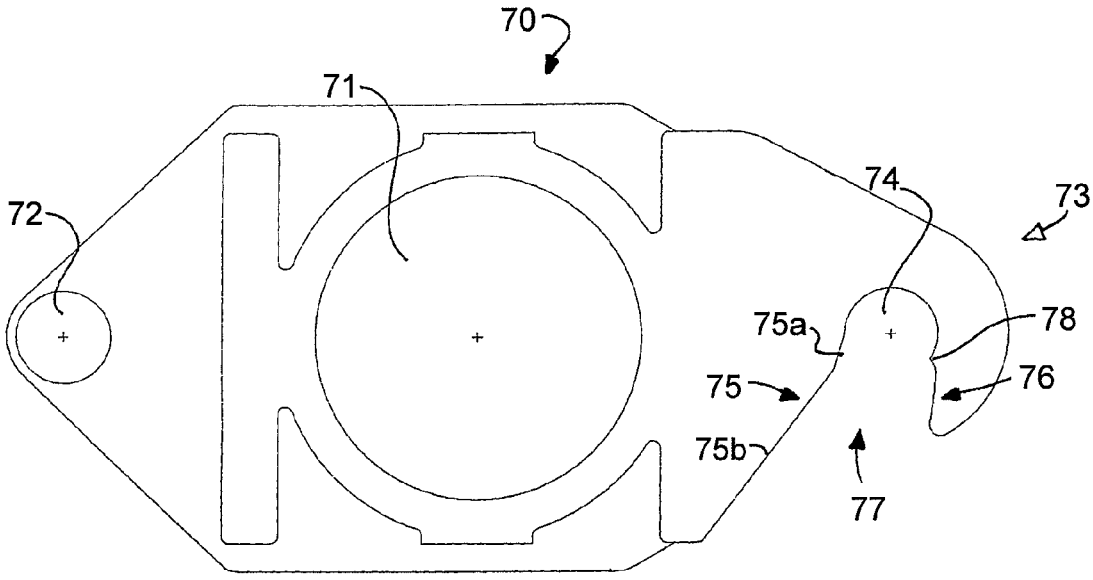
FIG. 18 is a cross-section through a preferred neck of the package of FIG. 9.

The neck 70 illustrated in FIG. 18 corresponds to that of FIGS. 10 and 11, and comprises a relatively rigid moulding having a circular opening 71, on one side of which is a pin 72 comprising a male coupler. On the other side is a hook 73 which comprises the female coupler and is defined by an interior portion 74, and a guide portion constituted by the sides 75,76 of a flared mouth 77.

The interior portion 74 comprises a snap-fit housing for the pin 72, and extends over slightly more than 180°. In the illustrated embodiment the pin 72 is of circular cross-section, and the portion 74 has a corresponding part-circular wall.

The guide portion at the pin side comprises straight walls 75*a*,75*b* which progressively open to define one side of the flared mouth 77. At the other side the guide portion 76 defines at the junction with the interior portion a peak 78, so that the flared mouth 77 opens immediately. The illustrated arrangement ensures that under tension, a chain of similar necks will not become decoupled whether turned to the left or to the right.

Although the invention has been described in relation to vending of water based drinks, the packages described here may also be used for domestic, medical and chemical products, includes food products and pharmaceuticals, particularly those which are water based and/or reconstituted from concentrates.

The invention is particularly suitable for low volume contract packaging, where the ability to deal with short runs of different fillings is important.

Figure 19:
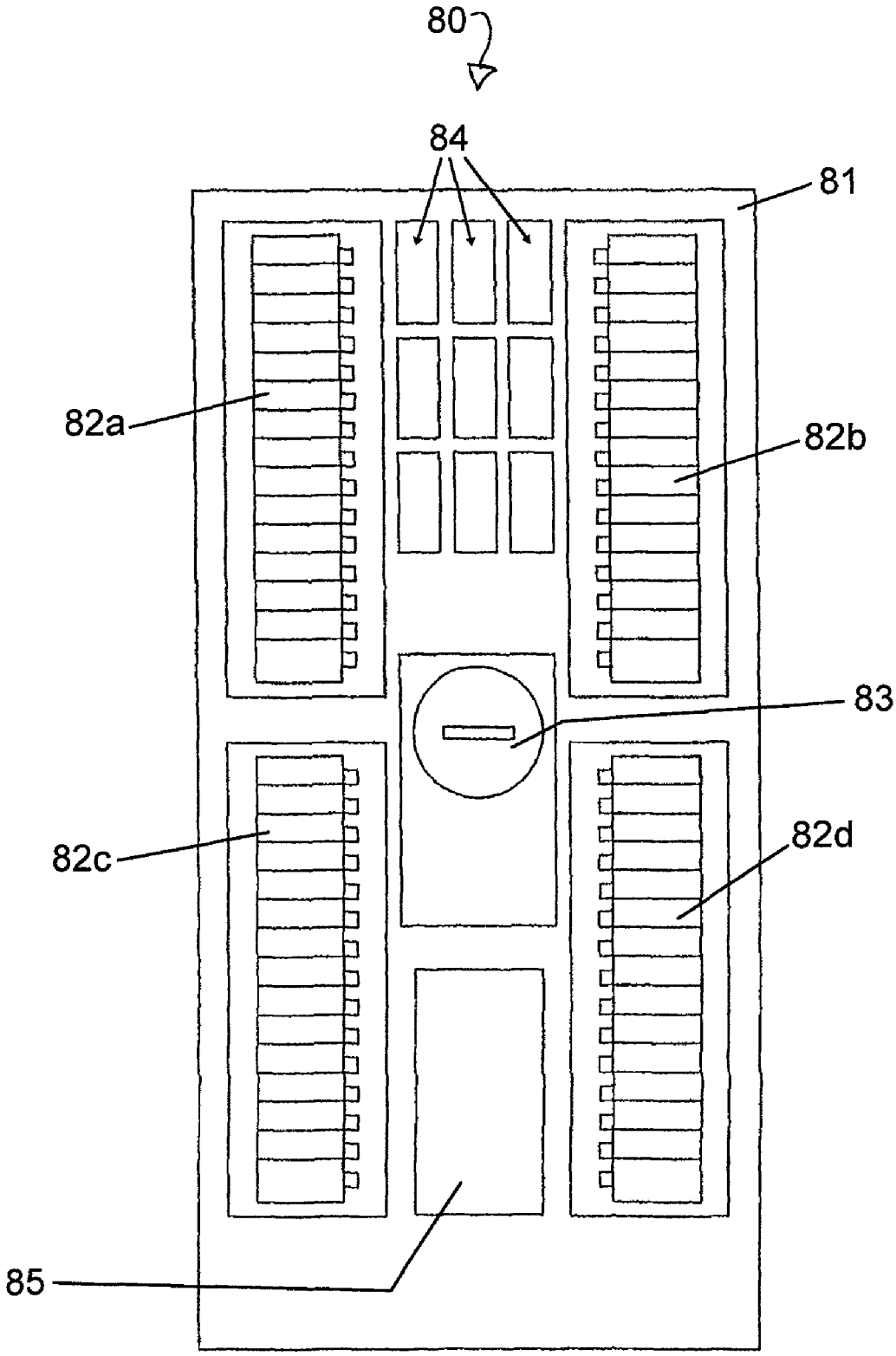
FIG. 19 is a front elevation of a preferred arrangement of dispenser.

FIG. 19 illustrates in front elevation a suitable arrangement for a dispensing machine 80 adapted for filling and dispensing packages to consumers.

A generally box-like rectangular cabinet 81, typically 2 m high, contains four reels of packaging 82*a*-82*d* arranged in the four corners about horizontal axes. The reels 82 may be in the form of bandoliers having for example 250 packages of the kind illustrated in FIG. 9.

A turntable device 83 in the approximate centre of the cabinet 81 carries indexable handling apparatus of the kind illustrated in FIGS. 12-17 and adapted to present a gripping head to the free end of one of the reels 82 via a suitable guide of the reel end. Four such guides are provided, one for the free end of each reel, so that as a reel becomes exhausted, the turntable is adapted to index the gripping head to the next free end, and so on. Suitable sensors to detect exhaustion are provided. The arrangement allows a high number of packages to be stored around a single filling apparatus. As will be appreciated, all reels unwind towards the centre, in the vicinity of the turntable device 83. Other means of indexing are possible, for example a lateral slide having four stations, one each associated with the end of each reel.

Centrally above the turntable device 83, is an array of individual flavouring containers 84, and below is provided a chiller 85. Other apparatus such as filters and carbonation devices may be included as desired. A dispensing chute, and optionally a coin freed mechanism is provided on a full height fascia, which is typically hinged to the front of the cabinet in the form of a door.

In typical use a consumer will select a drink, with or without payment, and the gripping head will grasp the next free container for uncapping and filling according to the consumers selection. At completion of filling, the cap is replaced to give a hermetic seal, and package is delivered to the consumer; the gripping head returns to the first position ready to grasp the succeeding container.

Figure 20:
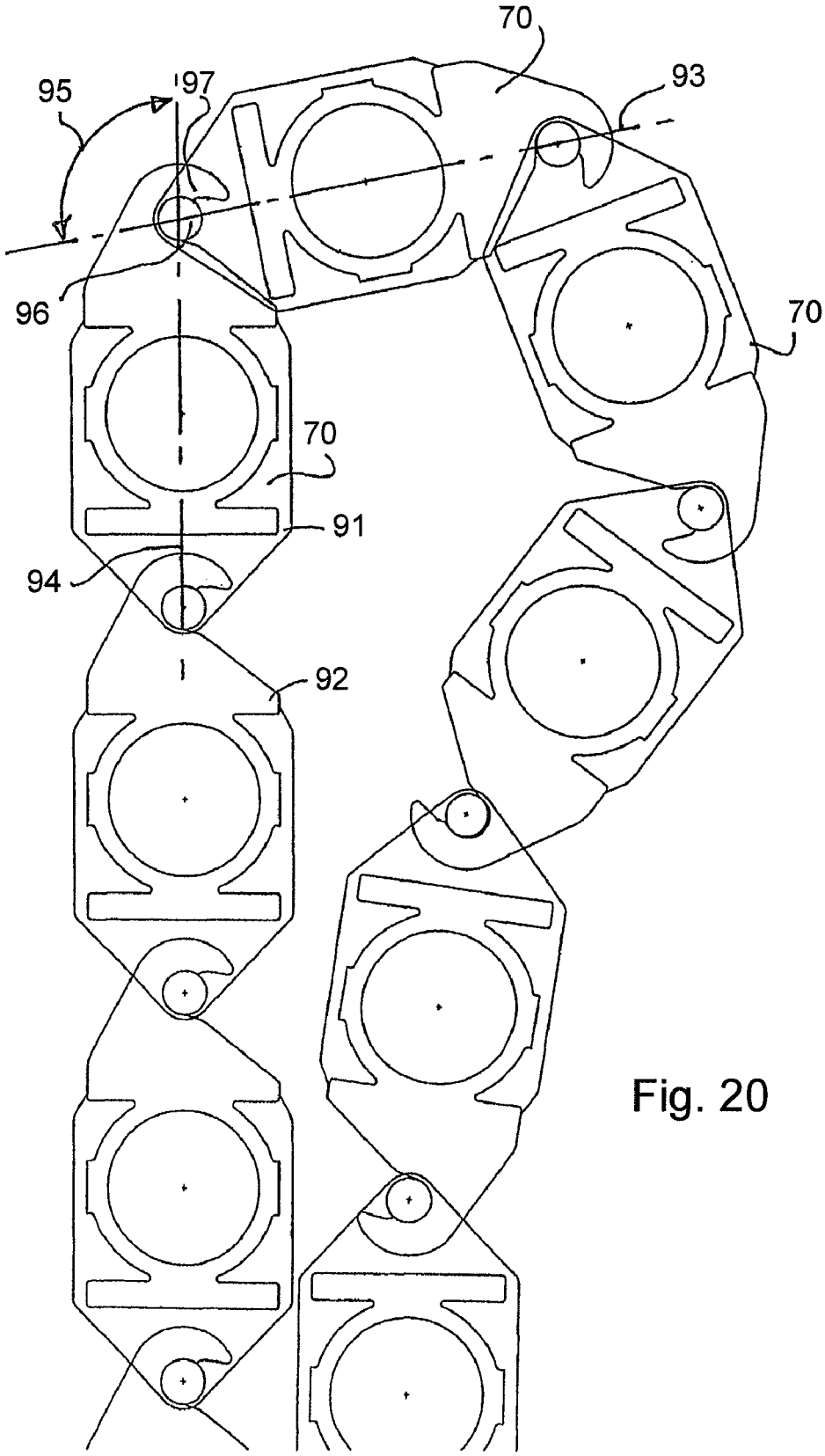
FIG. 20 illustrates a ribbon of necks of the kind illustrated in FIG. 18.

FIG. 20 shows a ribbon of necks or spouts 70 when curved oppositely to the arrangement of FIG. 11. In FIG. 11 the direction of curvature has the hooks 44 facing outwardly, and this direction ensures that the risk of accidental uncoupling is minimal. Accordingly a ribbon will normally be coiled in this direction.

It may however be necessary to cause a ribbon to curve in the opposite direction for handling purposes, or an operator may accidentally bend a ribbon oppositely during manual handling thereof. Such curvature is illustrated in FIG. 20, and is characterized by the hooks facing inwardly, generally towards the centre of curvature.

In this arrangement adjacent spouts 70 are arranged to be in abutment by virtue of opposite shoulders 91,92 so that the included angle 95 of lines 93,94 joining the pin and hook of adjacent spouts is not less than 90°.

As illustrated, it will be appreciated that the forces which are resultant from a force tending to tighten the curvature of FIG. 20 will be resisted by reaction of a pin 96 acting against a hook 97, rather than tending to urge the pin out of the hook.

Variations to the invention are possible within the scope of the Statements of Invention and claims forming part of this specification.

The invention claimed is:

1. A ribbon of interconnected collapsed containers, each container comprising a flexible container body that is flat in a collapsed state and a closure joined to one edge of the container body, the closure comprising a neck and a cap, the neck defining oppositely directed male and female couplings, the collapsed containers being interconnected by engagement of the male coupling of one container with the female coupling of an adjacent container, wherein the collapsed container bodies of adjacent containers overlap one another, and wherein the male and female couplings are configured to permit relative rotation between adjacent containers without causing detachment of the couplings such that the ribbon can be coiled.

2. The ribbon of claim 1, wherein the male and female couplings are adapted to remain coupled together when force is exerted on the ribbon along a length direction of the ribbon for moving the ribbon along a path, and are adapted to be separable on application of a disengagement force in a direction substantially orthogonal to said length direction.

3. The ribbon of claim 1, wherein the male and female couplings are adapted for snap-fit engagement.

4. The ribbon of claim 1, wherein the male coupling comprises a pin extending in a direction substantially parallel to said neck, and the female coupling comprises a 'C' shaped mouth.

5. The ribbon of claim 4, wherein the female coupling comprises a hook defining said mouth.

6. The ribbon of claim 5, wherein said mouth is directed substantially orthogonally to said first direction.

7. The ribbon of claim 5, wherein the mouth is narrowed at its opening to provide for snap-fit engagement with said pin.

8. The ribbon of claim 4, wherein said mouth extends circumferentially for slightly more than 180°.

9. The ribbon of claim 4, wherein said mouth further comprises a guide portion in the form of a flared mouth.

10. The ribbon of claim 9, wherein one side of the guide portion defines a peak at its junction with said flared mouth.

* * * * *